US005559088A

United States Patent [19]

Severns et al.

[11] Patent Number: 5,559,088

[45] Date of Patent: Sep. 24, 1996

[54] DRYER-ACTIVATED FABRIC CONDITIONING AND ANTISTATIC COMPOSITIONS WITH IMPROVED PERFUME LONGEVITY

[75] Inventors: John C. Severns, West Chester; Mark R. Sivik, Fairfield; Frederick A. Hartman, Cincinnati, all of Ohio; Hugo R. G. Denutte, Hofstade, Belgium; Jill B. Costa, Cincinnati; Alex H. Chung, West Chester, both of Ohio

[73] Assignee: The Proctor & Gamble Company, Cincinnati, Ohio

[21] Appl. No.: 499,158

[22] Filed: Jul. 7, 1995

[51] Int. Cl.[6] ..... D06M 13/224; D06M 13/46

[52] U.S. Cl. ..... 510/102; 512/18; 512/26; 560/190; 560/205; 560/221; 560/76; 560/95; 510/105; 510/106; 510/107; 510/519; 510/520

[58] Field of Search ..... 252/8.8, 8.9, 8.6, 252/174.11; 512/18, 26; 560/190, 205, 221, 76, 95

[56] References Cited

U.S. PATENT DOCUMENTS

| | | | |
|---|---|---|---|
| 2,847,383 | 8/1958 | Spencer et al. | 252/42.7 |
| 3,077,457 | 2/1963 | Kulka | 252/305 |
| 4,524,021 | 6/1985 | Wiegers et al. | 252/522 R |
| 4,668,433 | 5/1987 | Ochsner | 252/522 R |
| 4,677,223 | 6/1987 | Pittet et al. | 560/147 |
| 4,714,565 | 12/1987 | Wevers et al. | 252/174.19 |
| 4,965,000 | 10/1990 | Potts et al. | 252/8.75 |
| 5,081,111 | 1/1992 | Akimoto et al. | 525/285 |
| 5,298,569 | 3/1994 | Yamamori et al. | 525/329.5 |
| 5,320,837 | 1/1994 | Akimoto et al. | 424/78.19 |
| 5,336,767 | 8/1994 | della Valle et al. | 536/55.1 |
| 5,376,287 | 12/1994 | Burcher, Sr. et al. | 252/8.8 |
| 5,378,468 | 1/1995 | Suffis et al. | 424/401 |
| 5,445,747 | 8/1995 | Kvietok et al. | 252/8.6 |
| 5,474,691 | 12/1995 | Severns et al. | 252/8.9 |

FOREIGN PATENT DOCUMENTS

| | | | |
|---|---|---|---|
| 228671 | 7/1958 | Australia . | |
| 304073 | 12/1988 | Japan . | |
| 3-17025 | 1/1991 | Japan | A61K 47/48 |
| 588 | 8/1979 | WIPO . | |

OTHER PUBLICATIONS

McGee H. L. Some Physical Properties of Long Chained Esters of Dibasic Acids Journal of Chemical and Engineering Data Jan. 1962 vol. 7 No. 1 pp. 102–106.

*Primary Examiner*—Paul Lieberman
*Assistant Examiner*—Michael P. Tierney
*Attorney, Agent, or Firm*—Thomas G. Krivulka

[57] ABSTRACT

The present invention relates to dryer-activated fabric softening compositions comprising: (A) fabric softening compounds; (B) a non-allylic perfume alcohol ester; and (C) optionally, (1) a carboxylic acid salt of a tertiary amine and/or a tertiary amine ester; and (2) a nonionic softener; wherein, preferably, the Iodine Value of the total number of fatty acyl groups present in (A), (C)(1), and (C)(2) is from about 3 to about 60. These compositions exhibit good antistatic properties as well as improved delivery from a substrate.

28 Claims, No Drawings

DRYER-ACTIVATED FABRIC CONDITIONING AND ANTISTATIC COMPOSITIONS WITH IMPROVED PERFUME LONGEVITY

TECHNICAL FIELD

The present invention relates to an improvement in dryer activated, e.g., dryer-added, softening products, compositions, and/or the process of making these compositions. These products and/or compositions are either in particulate form, compounded with other materials in solid form, e.g., tablets, pellets, agglomerates, etc., or preferably attached to a substrate.

BACKGROUND OF THE INVENTION

Consumer acceptance of laundry products is determined not only by the performance achieved with these products but the aesthetics associated therewith. The perfume systems are therefore an important aspect of the successful formulation of such commercial products.

What perfume system to use for a given product is a matter of careful consideration by skilled perfumers. While a wide array of chemicals and ingredients are available to perfumers, considerations such as availability, cost, and compatibility with other components in the compositions limit the practical options. Thus, there continues to be a need for low-cost, compatible perfume materials useful for laundry compositions.

Furthermore, due to the high energy input and large air flow in the drying process used in the typical automatic laundry dryers, a large part of most perfumes provided by fabric softener products is lost from the dryer vent. Perfume can be lost even when the fabrics are line dried. Concurrent with effort to reduce the environmental impact of fabric softener compositions, it is desirable to formulate efficient, enduring fabric softener perfume compositions that remain on fabric for aesthetic benefit, and are not lost, or wasted, without benefiting the laundered items.

The present invention provides improved compositions with less environmental impact due to using a combination of softener and efficient perfumes in dryer-activated fabric softening compositions while, surprisingly, also providing improved longevity of perfumes on the laundered clothes, by utilizing enduring perfume compositions.

It has been discovered that esters of certain nonionic and artionic non-allylic perfume alcohols are particularly well suited for fabric softening compositions. In particular, it has been discovered that depending on the acid group utilized and/or fabric softening compositions into which these are incorporated, esters of non-allylic perfume alcohols will gradually hydrolyze to release the non-allylic alcohol perfume. In addition, slowly hydrolyzable esters of non-allylic perfume alcohols provide release of the perfume over a longer period of time than by the use of the perfume itself in the biodegradable fabric softening compositions. Such materials therefore provide perfumers with more options for perfume ingredients and more flexibility in formulation considerations. These and other advantages of the present invention will be seen from the disclosures hereinafter.

BACKGROUND ART

General ester chemistry is described in Carey et al., Advanced Organic Chemistry, Part A, 2nd Ed., pp. 421–426 (Plenum, N.Y.; 1984).

Compositions of fragrance materials (having certain values for Odour Intensity Index, Malodour Reduction Value and Odour Reduction Value) said to be used as fragrance compositions in detergent compositions and fabric conditioning compositions are described in European Patent Application Publication No. 404,470, published December 27, 1990 by Unilever PLC. Example 1 describes a fabric-washing composition containing 0.2% by weight of a fragrance composition which itself contains 4.0 % geranyl phenylacetate. A process for scenting fabrics washed with lipase-containing detergents is described in PCT application No. WO 95/04809, published Feb. 16, 1995 by Firmenich S. A.

SUMMARY OF THE INVENTION

The present invention relates to dryer-activated fabric softening compositions and articles having improved biodegradability, softness, perfume delivery from sheet substrates (lower m.p. range), and/or antistatic effects, for use in an automatic clothes dryer. These compositions and/or articles comprise, as essential ingredients:

(A) from about 10% to about 99.99%, preferably from about 15% to about 90%, more preferably from about 30% to about 85%, and even more preferably from about 30% to about 55%, of fabric softening compound, preferably quaternary ammonium compound, more preferably biodegradable, and even more preferably, selected from the group consisting of the compounds of Formulas I, II, III, IV, and mixtures thereof, as described hereinafter; and (B) from about 0.01% to about 15%, by weight of the composition, of nonionic or anionic compound that is an ester of non-allylic alcohol, wherein said non-allylic alcohol forming said ester is a perfume with a boiling point at 760 mm Hg of less than about 300° C., wherein H—O—$CR'_2$—$CR''_2$—$CR'''_3$ is said non-allylic alcohol, said ester having the formula:

$$R-(\overset{\overset{\displaystyle O}{\|}}{C}-O-CR'_2-CR''_2-CR'''_3)_n$$

wherein R, R', R", and R"' are as described hereinafter, and n is an integer of 1 or greater.

R is selected from the group consisting of $C_1$–$C_{30}$, preferably $C_1$–$C_{20}$, straight, branched or cyclic alkyl, alkenyl, alkynyl, alkyl-aryl, or aryl group, excluding $CH_3$— and $CH_3CH_2$—, and represents the group attached to the carboxylate function of the moiety reacted with the perfume alcohol used to make the perfume ester. R is selected to give the perfume ester its desired chemical and physical properties such as: 1) chemical stability in the product matrix, 2) formulatability into the product matrix, 3) desirable rate of perfume release, etc. The product(s) and rate of hydrolysis of the non-allylic alcohol ester can be controlled by the selection of R. Esters having more than one carboxylate group per molecule (e.g., diesters, triesters) are also included within the scope of the present invention, and are preferred.

Each R' is independently selected from the group consisting of hydrogen, or a $C_1$–$C_{25}$ straight, branched or cyclic alkyl, alkenyl, alkynyl, alkyl-aryl, or aryl group. The two R' moieties can be the same or different. Preferably at least one R' is hydrogen.

Each R" is independently selected from the group consisting of hydrogen, or a $C_1$–$C_{25}$ straight, branched or cyclic alkyl, alkenyl, alkynyl, alkyl-aryl, or aryl group. The two R" moieties can be the same or different.

Each R''' is independently selected from the group consisting of hydrogen, or a $C_1$–$C_{25}$ straight, branched or cyclic alkyl, alkenyl, alkynyl, alkyl-aryl, or aryl group. The R'' can be the same or different. Preferably, one R''' is hydrogen or a straight, branched or cyclic $C_1$–$C_{20}$ alkyl or alkenyl groups. More preferably, one R''' is hydrogen, methyl, ethyl, or alkenyl and another R''' is a straight, branched or cyclic $C_1$–$C_{20}$ alkyl, alkenyl or alkyl-aryl group.

In addition, each of the above R, R', R'', and R''' moieties can be unsubstituted or substituted with one or more nonionic and/or anionic substituents. Such substituents can include, for example, halogens, nitro, carboxy, carbonyl, sulfate, sulfonate, hydroxy, and alkoxy, and mixtures thereof.

The active fabric softening components preferably contain unsaturation to provide improved antistatic benefits. The Iodine Value of the composition is preferably from about 3 to about 60, more preferably from about 8 to about 50, and even more preferably from about 12 to about 40. The Iodine Value of the composition represents the Iodine Value of the total fatty acyl groups present in components (A), (C)(1), and (C)(2) described below. The unsaturation may be present in one or more of the active components of (A), (C)(1), and/or (C)(2).

DETAILED DESCRIPTION OF THE INVENTION

The present invention relates to fabric softening compositions and articles having improved biodegradability, softness, delivery from the sheet, and/or antistatic effects, for use in an automatic clothes dryer. These compositions comprise, as essential ingredients:

(A) from about 10% to about 99.99%, preferably from about 15% to about 90%, more preferably from about 30% to about 85%, and even more preferably from about 30% to about 55%, of fabric softening compound, preferably quaternary ammonium compound, more preferably biodegradable, and even more preferably, selected from the group consisting of the compounds of Formulas I, II, III, IV, and mixtures thereof, as described hereinafter; and (B) from about 0.01% to about 15%, by weight of the composition, of nonionic or anionic compound that is an ester of non-allylic alcohol, wherein said non-allylic alcohol forming said ester is a perfume with a boiling point at 760 mm Hg of less than about 300° C., wherein H—O—$CR'_2$–$CR''_2$–$CR'''_3$ is said non-allylic alcohol, said ester having the formula:

$$R-(\overset{\overset{\displaystyle O}{\|}}{C}-O-CR'_2-CR''_2-CR'''_3)_n$$

wherein R, R', R'', and R''' are as described hereinbefore, and n is an integer of 1 or greater.

Preferably, the active fabric softening components contain unsaturation to provide antistatic benefits. The unsaturation of the active components provides in-dryer melting of these active components and provides high efficient transfer for improved performance, especially at lower dryer temperatures, while minimizing stickiness of the articles. The Iodine Value of the fabric softening composition is preferably from about 3 to about 60, more preferably from about 8 to about 50, and even more preferably from about 12 to about 40. The Iodine Value of the composition represents the Iodine Value of the total fatty acyl groups present in components (A), (C)(1), and (C)(2) as described hereinafter. The unsaturation may be present in one or more of the active components of (A), (C)(1), or (C)(2).

The selection of the components is such that the resulting fabric treatment composition has a thermal softening point above about 38° C and is transferable at dryer operating temperatures.

A. Fabric Softening Compound

Compositions of the present invention contain from about 10% to about 99.99%, preferably from about 15% to about 90%, more preferably from about 30% to about 85%, and even more preferably from about 30% to about 55%, of fabric softening compound, preferably ester quaternary ammonium compound (EQA).

Preferably, the EQA of the present invention is selected from Formulas I, II, III, IV, and mixtures thereof.

Formula I comprises:

$$(R^1)_{4-p}-N^+-((CH_2)_v-Y-R^2)_p\ X^-$$

wherein each Y=—O—(O)C—, or —C(O)—O—;

p=1 to 3;

each v=is an integer from 1 to 4, and mixtures thereof, each $R^1$ substituent is a short chain $C_1$–$C_6$, preferably $C_1$–$C_3$, alkyl group, e.g., methyl (most preferred), ethyl, propyl, and the like, benzyl and mixtures thereof; each $R^2$ is a long chain, saturated and/or unsaturated (IV of from about 3 to about 60), $C_8$–$C_{30}$ hydrocarbyl, or substituted hydrocarbyl substituent and mixtures thereof; and the counterion, $X^-$ can be any softener-compatible anion, for example, methylsulfate, ethylsulfate, chloride, bromide, formate, sulfate, lactate, nitrate, benzoate, and the like, preferably methylsulfate.

It will be understood that substituents $R^1$ and $R^2$ of Formula I can optionally be substituted with various groups such as alkoxyl or hydroxyl groups. The preferred compounds can be considered to be diester (DEQA) variations of ditallow dimethyl ammonium methyl sulfate (DTDMAMS), which is a widely used fabric softener. At least 80% of the DEQA is in the diester form, and from 0% to about 20%, preferably less than about 10%, more preferably less than about 5%, can be EQA monoester (e.g., only one—Y—$R^2$ group).

As used herein, when the diester is specified, it will include the monoester that is normally present. For the optimal antistatic benefit the percentage of monoester should be as low as possible, preferably less than about 2.5%. The level of monoester present can be controlled in the manufacturing of the EQA.

EQA compounds prepared with fully saturated acyl groups are rapidly biodegradable and excellent softeners. However, it has now been discovered that compounds prepared with at least partially unsaturated acyl groups have advantages (i.e., antistatic benefits) and are highly acceptable for consumer products when certain conditions are met.

Variables that must be adjusted to obtain the benefits of using unsaturated acyl groups include the Iodine Value of the fatty acids, the odor of fatty acid starting material, and/or the EQA. Any reference to Iodine Value values hereinafter refers to Iodine Value of fatty acyl groups and not to the resulting EQA compound.

Antistatic effects are especially important where the fabrics are dried in a tumble dryer, and/or where synthetic materials which generate static are used. As the Iodine Value is raised, there is a potential for odor problems.

Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior performance which has not been recognized.

Generally, hydrogenation of fatty acids to reduce polyunsaturation and to lower Iodine Value to insure good color and odor stability leads to a high degree of trans configuration in the molecule. Therefore, diester compounds derived from fatty acyl groups having low Iodine Value values can be made by mixing fully hydrogenated fatty acid with touch hydrogenated fatty acid at a ratio which provides an Iodine Value of from about 3 to about 60. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

It has been found that a solvent may be used to facilitate processing of the Formula I EQA and/or of the fabric softening composition containing the Formula I EQA. Possible solvents include $C_1$–$C_{30}$ alcohols, with secondary and tertiary alcohols preferred, e.g., isopropanol, and $C_8$–$C_{30}$ fatty acids.

It has also been found that for good chemical stability of the diester quaternary compound in molten storage, water levels in the raw material must be minimized to preferably less than about 1% and more preferably less than about 0.5%. Storage temperatures should be kept as low as possible and still maintain a fluid material, ideally in the range of from about 45° C. to about 70° C. The optimum storage temperature for stability and fluidity depends on the specific Iodine Value of the fatty acid used to make the diester quaternary and the level/type of solvent selected. Also, exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

The following are non-limiting examples of EQA Formula I (wherein all long-chain alkyl substituents are straight-chain):

Saturated $(C_2H_5)_2{}^+N(CH_2CH_2OC(O)C_{17}H_{35})_2(CH_3SO_4)^-$ $(HO-CH(CH_3)CH_2)(CH_3)^+N(CH_2CH_2OC(O)C_{15}H_{31})_2Br^-$ $(CH_3)(C_2H_5)^+N(CH_2CH_2OC(O)C_{13}H_{27})_2(HCOO)^-$ $(C_3H_7)(C_2H_5)^+N(CH_2CH_2OC(O)C_{11}H_{23})_2(CH_3SO_4)^-$ $(CH_3)_2{}^+N(CH_2CH_2OC(O)C_{15}H_{31})(CH_3SO_4)^-$
$\quad\quad |$
$\quad\quad CH_2CH_2OC(O)C_{17}H_{35}$ $(CH_3)_2{}^+N(CH_2CH_2OC(O)R)_2(CH_3SO_4)^-$ where $—C(O)R^2$ is derived from saturated tallow.

Unsaturated $(CH_3)_2{}^+N(CH_2CH_2OC(O)C_{17}H_{33})_2(CH_3SO_4)^-$ $(HO-CH(CH_3)CH_2)(CH_3)^+N(CH_2CH_2OC(O)C_{15}H_{29})_2(HCOO)^-$ $(C_2H_5)_2{}^+N(CH_2CH_2OC(O)C_{17}H_3)_2Cl^-$ $(CH_3)(C_2H_5)^+N(CH_2CH_2OC(O)C_{13}H_{35})_2(C_6H_5COO)^-$ $(CH_3)_2{}^+N-CH_2CH_2OC(O)C_{15}H_{29}(CH_3CH_2SO_4)^-$
$\quad\quad |$
$\quad\quad CH_2CH_2OC(O)C_{17}H_{33}$ $(CH_2CH_2OH)(CH_3)^+N(CH_2CH_2OC(O)R^2)_2(CH_3SO_4)^-$ $(CH_3)_2N(CH_2CH_2OC(O)R^2)_2(CH_3SO_4)^-$ where $—C(O)R^2$ is derived from partially hydrogenated tallow or modified tallow having the characteristics set forth herein.

In addition to Formula I compounds, the compositions and articles of the present invention comprise EQA compounds of Formula II:

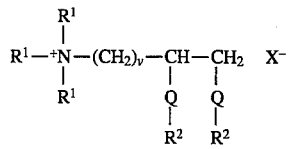

wherein, for any molecule:

each Q is

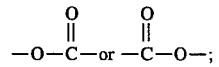

each $R^1$ is $C_1$–$C_4$ alkyl or hydroxy alkyl;

$R^2$ and v are defined hereinbefore for Formula I; and wherein preferably $R^1$ is a methyl group, v is 1, Q is

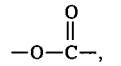

each $R^2$ is $C_{14}$–$C_{18}$, and X is methyl sulfate.

The straight or branched alkyl or alkenyl chains, $R^2$, have from about 8 to about 30 carbon atoms, preferably from about 14 to about 18 carbon atoms, more preferably straight chains having from about 14 to about 18 carbon atoms.

Tallow is a convenient and inexpensive source of long chain alkyl and alkenyl materials.

A specific example of a biodegradable Formula II EQA compound suitable for use in the fabric softening compositions herein is: 1,2-bis(tallowyl oxy)-3-trimethyl ammoniopropane methylsulfate (DTTMAPMS).

Other examples of suitable Formula II EQA compounds of this invention are obtained by, e.g., replacing "tallowyl" in the above compounds with, for example, cocoyl, lauryl, oleyl, stearyl, palmityl, or the like;

replacing "methyl" in the above compounds with ethyl, propyl, isopropyl, butyl, isobutyl, t-butyl, or the hydroxy substituted analogs of these radicals;

replacing "methylsulfate" in the above compounds with chloride, ethylsulfate, bromide, formate, sulfate, lactate, nitrate, and the like, but methylsulfate is preferred.

In addition to Formula I and Formula II compounds, the compositions and articles of the present invention comprise EQA compounds of Formula III:

$$R^1-\underset{\underset{R^4}{|}}{N^+}((CH_2)_v-Y-R^2)_p \quad X^-$$

wherein $R^4$=a short chain $C_1$–$C_4$ alcohol;

p is 2;

$R^1$, $R^2$, v, Y, and $X^-$ are as previously defined for Formula I.

A specific example of a biodegradable Formula III compound suitable for use in the fabric softening compositions herein is N-methyl-N,N-di-(2-($C_{14}$–$C_{18}$-acyloxy) ethyl), N-2-hydroxyethyl ammonium methylsulfate. A preferred compound is N-methyl, N,N-di-(2-oleyloxyethyl)N-2-hydroxyethyl ammonium methylsulfate.

Compositions of the present invention may also comprise Formula IV compounds:

$$(R^1)_{4-p}-N^+-((CH_2)_v-Y''-R^2)_p \; X^-$$

$R^1$, $R^2$, p, v, and X are previously defined in Formula I; and $$Y'' = -NH-\overset{\overset{O}{||}}{C}-;\ -\overset{\overset{O}{||}}{C}-NH-;\ -\overset{\overset{O}{||}}{C}-O-;\ -O-\overset{\overset{O}{||}}{C}-;$$

and mixtures thereof, wherein at least one Y" group is $$-NH-\overset{\overset{O}{||}}{C}-\text{or}\ -\overset{\overset{O}{||}}{C}-NH-.$$

An example of this compound is methyl bis (oleyl amidoethyl)2-hydroxyethyl ammonium methyl sulfate.

Preferably, Component (A) of the present invention is a biodegradable quaternary ammonium compound.

The compounds herein can be prepared by standard esterification and quaternization reactions, using readily available starting materials. General methods for preparation are disclosed in U.S. Pat. No. 4,137,180, incorporated herein by reference.

B. Non-allylic Perfume Alcohol Esters

The non-allylic perfume alcohol esters employed herein contain from about 0.01% to about 15%, by weight of the composition, of nonionic or anionic ester of non-allylic alcohol perfume having the formula:

$$R-(\overset{\overset{O}{||}}{C}-O-CR'_2-CR''_2-CR'''_3)_n$$

R is selected from the group consisting of $C_1$–$C_{30}$, preferably $C_1$–$C_{20}$, straight, branched or cyclic alkyl, alkenyl, alkynyl, alkyl-aryl, or aryl group, excluding $CH_3$— and $CH_3CH_2$—, and represents the group attached to the carboxylate function of the moiety reacted with the perfume alcohol used to make the perfume ester. R is selected to give the perfume ester its desired chemical and physical properties such as: 1) chemical stability in the product matrix, 2) formulatability into the product matrix, 3) desirable rate of perfume release, etc. The product(s) and rate of hydrolysis of the non-allylic alcohol ester can be controlled by the selection of R. Esters having more than one carboxylate group per molecule (e.g., diesters; triesters) are also included within the scope of the present invention, and are preferred.

The formation of esters from alcohols is well known in the art. The esters of the present invention are formed from alcohols that are perfumes having a boiling point at 760 mm Hg of less than about 300° C. having the following general structure:

$$H-O-CR'_2-CR''_2-CR'''_3$$

wherein R', R", and R"' are as described hereinafter.

Each R' is independently selected from the group consisting of hydrogen, or a $C_1$–$C_{25}$ straight, branched or cyclic alkyl, alkenyl, alkynyl, alkyl-aryl, or aryl group. The two R' moieties can be the same or different. Preferably at least one R' is hydrogen.

Each R" is independently selected from the group consisting of hydrogen, or a $C_1$–$C_{25}$ straight, branched or cyclic alkyl, alkenyl, alkynyl, alkyl-aryl, or aryl group. The two R" moieties can be the same or different.

Each R"' is independently selected from the group consisting of hydrogen, or a $C_1$–$C_{25}$ straight, branched or cyclic alkyl, alkenyl, alkynyl, alkyl-aryl, or aryl group. The R"' can be the same or different. Preferably, one R"' is hydrogen or a straight, branched or cyclic $C_1$–$C_{20}$ alkyl or alkenyl groups. More preferably, one R"' is hydrogen, methyl, ethyl, or alkenyl and another R"' is a straight, branched or cyclic $C_1$–$C_{20}$ alkyl, alkenyl or alkyl-aryl group.

In addition, each of the above R, R', R", and R"' moieties can be unsubstituted or substituted with one or more nonionic and/or anionic substituents. Such substituents can include, for example, halogens, nitro, carboxy, carbonyl, sulfate, sulfonate, hydroxy, and alkoxy, and mixtures thereof.

The preferred compositions comprise the esters of the following perfume alcohols:

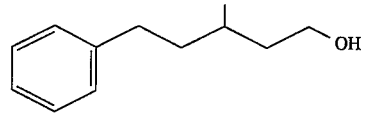

phenoxanol;

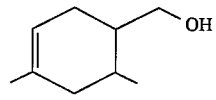

floralol;

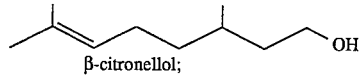

β-citronellol;

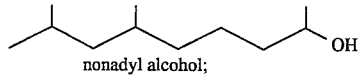

nonadyl alcohol;

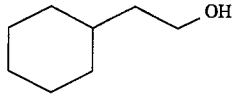

cyclohexyl ethanol;

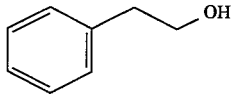

phenyl ethanol;

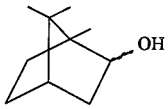

isoborneol;

-continued

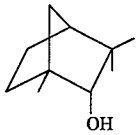

fenchol;

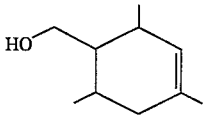

isocyclogeraniol;

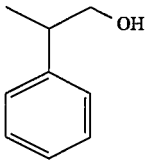

2-phenyl-1-propanol

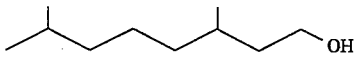

and/or 3,7-dimethyl-1-octanol.

and/or 3,7-dimethyl-1-octanol.

Most preferred esters for use herein are:

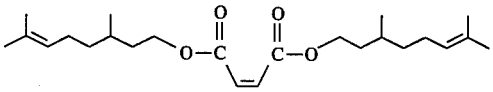

referred to herein as"di-β-citronellyl maleate" and

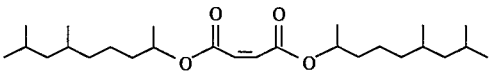

referred to herein as "dinonadyl maleate" and

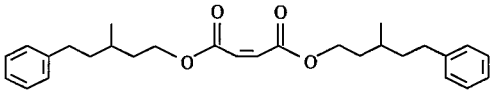

referred to herein as "diphenoxanyl maleate"; and

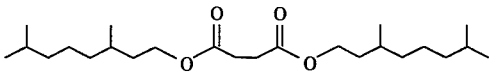

referred to herein as "di(3,7-dimethyl-1-octanyl) succinate"; and

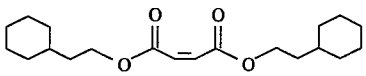

referred to herein as "di(cyclohexylethyl)maleate"; and

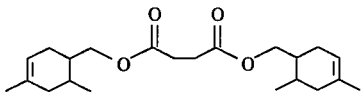

referred to herein as "difloralyl succinate"; and

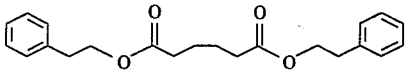

referred to herein as "di(phenylethyl)adipate".

C. Optional Ingredients

Well known optional components included in fabric conditioning compositions are narrated in U.S. Pat. No. 4,103,047, Zaki et al ., issued Jul. 25, 1978, for"Fabric Treatment Compositions," incorporated herein by reference.

(1) Co-Softener

Fabric softening compositions employed herein contain as an optional component, at a level of from about 0% to about 95%, preferably from about 20% to about 75%, more preferably from about 20% to about 60%, a carboxylic acid salt of a tertiary amine and/or ester amine which has the formula:

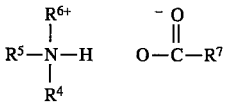

wherein $R^5$ is a long chain aliphatic group containing from about 8 to about 30 carbon atoms; $R^6$ and $R^4$ are the same or different from each other and are selected from the group consisting of aliphatic groups containing containing from about 1 to about 30 carbon atoms, hydroxyalkyl groups of the Formula $R^8OH$ wherein $R^8$ is an alkylene group of from about 2 to about 30 carbon atoms, and alkyl ether groups of the formula $R^9O(C_nH_{2n}O)_m$ wherein $R^9$ is alkyl and alkenyl of from about 1 to about 30 carbon atoms and hydrogen, v is 2 or 3, and m is from about 1 to about 30; wherein $R^4$, $R^5$, $R^6$, $R^8$, and $R^9$ chains can be ester interrupted groups; and wherein $R^7$ is selected from the group consisting of unsubstituted alkyl, alkenyl, aryl, alkaryl and aralkyl of about 8 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a thermal softening point of from about 35° C. to about 100° C.

This essential component provides the following benefits: superior odor, and/or improved fabric softening performance, compared to similar articles which utilize primary amine or ammonium compounds as the sole fabric conditioning agent. Either $R^4$, $R^5$, $R^6$, $R^7$, $R^8$, and/or $R^9$ chains can contain unsaturation.

Additionally, tertiary amine salts of carboxylic acids have superior chemical stability, compared to primary and secondary amine carboxylate salts. For example, primary and secondary amine carboxylates tend to form amides when heated, e.g., during processing or use in the dryer. Also, they absorb carbon dioxide, thereby forming high melting carbamates which build up as an undesirable residue on treated fabrics.

Preferably, $R^5$ is an aliphatic chain containing from about 12 to about 30 carbon atoms, $R^6$ is an aliphatic chain of from about 1 to about 30 carbon atoms, and $R^4$ is an aliphatic chain of from about 1 to about 30 carbon atoms. Particularly preferred tertiary amines for static control performance are those containing unsaturation; e.g., oleyldimethylamine and/or soft tallowdimethylamine.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and

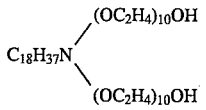

Preferred fatty acids are those wherein $R^7$ is a long chain, unsubstituted alkyl or alkenyl group of from about 8 to about 30 carbon atoms, more preferably from about 11 to about 17 carbon atoms.

Examples of specific carboxylic acids as a starting material are: formic acid, acetic acid, laurie acid, myristic acid, palmitic acid, stearic acid, oleic acid, oxalic acid, adipic acid, 12-hydroxy stearic acid, benzoic acid, 4-hydroxy benzoic acid, 3-chloro benzoic acid, 4-nitro benzoic acid, 4-ethyl benzoic acid, 4-(2-chloroethyl)benzoic acid, phenylacetic acid, (4-chlorophenyl)acetic acid, (4-hydroxyphenyl)acetic acid, and phthalic acid.

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980, which is incorporated herein by reference. Excessive levels of free amines may result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyi methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyidimethylamine stearate, stearyldimethylamine myristate, stearyidimethylamine oleate, stearyldimethylamine palmitate, distearylmethylamine palmitate, distearylmethylamine laurate, and mixtures thereof. A particularly preferred mixture is oleyldimethylamine stearate and distearylmethylamine myristate, in a ratio of 1:10 to 10:1, preferably about 1:1.

(2) Optional Nonionic Softener

An optional softening agent of the present invention is a nonionic fabric softener material. Typically, such nonionic fabric softener materials have an HLB of from about 2 to about 9, more typically from about 3 to about 7. In general, the materials selected should be relatively crystalline, higher melting, (e.g., >25° C.).

The level of optional nonionic softener in the solid composition is typically from about 10% to about 50%, preferably from about 15% to about 40%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 12 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan.

The fatty acid portion of the ester is normally derived from fatty acids having from about 8 to about 30, preferably from about 12 to about 22, carbon atoms. Typical examples of said fatty acids being lauric acid, myristic acid, palmitic acid, stearic acid, oleic acid, and behenic acid.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 6 oxyethylene units, and mixtures thereof. For the purpose of the present invention, sorbitan esters containing unsaturation (e.g., sorbitan monooleate) can be utilized.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society*, Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the"lower" ethoxylates thereof (i.e., mono-, di-, and tri-esters wherein one or more of the unesterified —OH groups contain one to about twenty oxyethylene moieties (Tweens®) are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid, ester, or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglyceroi through octaglycerol esters. The polyglycerol polyols are formed by condensing glycerin or epichlorohydrin together to link the glycerol moieties via ether linkages. The mono and/or diesters of the polyglycerol polyol s are preferred, the fatty acyl groups typically being those described hereinbefore for the sorbitan and glycerol esters.

(3) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

A more complete disclosure of these highly preferred soil release agents is contained in European Pat. Application 185,427, Gosselink, published Jun. 25, 1986, incorporated herein by reference.

(4) Optional Cyclodextrin/Perfume Complexes and Free Perfume

The products herein can also contain from about 0.5% to about 60%, preferably from about 1% to about 50%, cyclodextrin/perfume inclusion complexes and/or free perfume, as disclosed in U.S. Pat. Nos. 5,139,687, Borcher et al., issued Aug. 18, 1992; and 5,234,610, Gardlik et al ., to issue Aug. 10, 1993, which are incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The optional perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference. Many of the art recognized perfume compositions are relatively substantive to maximize their odor effect on substrates. However, it is a special advantage of perfume delivery via the perfume/cyclodextrin complexes that non-substantive perfumes are also effective.

If a product contains both free and complexed perfume, the escaped perfume from the complex contributes to the overall perfume odor intensity, giving rise to a longer lasting perfume odor impression.

As disclosed in U.S. Pat. No. 5,234,610, Gardlik/Trinh/Banks/Benvegnu, issued Aug. 3, 1993, said patent being incorporated herein by reference, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

(5) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.05% to about 0.1% for antioxidants and more preferably from about 0.01% to about 0.2% for reductive agents. These assure good odor stability under long term storage conditions for the compositions. Use of antioxidants and reductive agent stabilizers is especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT, BHA, propyl gallate, and citric acid available from Eastman Chemicals Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA.

Examples of reductive agents include sodium borohydride, hypophosphorous acid, and mixtures thereof.

(6) Other Optional Ingredients

The present invention can include other optional components (minor components) conventionally used in textile treatment compositions, for example, colorants, preservatives, optical brighteners, opacifiers, stabilizers such as guar gum and polyethylene glycol, anti-shrinkage agents, anti-wrinkle agents, fabric crisping agents, spotting agents, germicides, fungicides, anti-corrosion agents, antifoam agents, and the like.

D. Substrate Articles

In preferred embodiments, the present invention encompasses articles of manufacture. Representative articles are those that are adapted to soften fabrics in an automatic laundry dryer, of the types disclosed in U.S. Pat. No. : 3,989,631 Marsan, issued Nov. 2, 1976; U.S. Pat. No. 4,055,248, Marsan, issued Oct. 25, 1977; U.S. Pat. No. 4,073,996, Bedenk et al., issued Feb. 14, 1978; U.S. Pat. No. 4,022,938, Zaki et al., issued May 10, 1977; U.S. Pat. No. 4,764,289, Trinh, issued Aug. 16, 1988; U.S. Pat. No. 4,808,086, Evans et al., issued Feb. 28, 1989; U.S. Pat. No. 4,103,047, Zaki et al., issued Jul. 25, 1978; U.S. Pat. No. 3,736,668, Dillarstone, issued Jun. 5, 1973; U.S. Pat. No. 3,701,202, Compa et al., issued Oct. 31, 1972; U.S. Pat. No. 3,634,947, Furgal, issued Jan. 18, 1972; U.S. Pat. No. 3,633,538, Hoeflin, issued Jan. 11, 1972; and U.S. Pat. No. 3,435,537, Rumsey, issued Apr. 1, 1969; and U.S. Pat. No. 4,000,340, Murphy et al., issued Dec. 28, 1976, all of said patents being incorporated herein by reference.

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g, most preferably from about 1 g to about 10 g.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Another article comprises a sponge material releasably enclosing enough fabric treatment composition to effectively impart fabric soil release, antistatic effect and/or softness benefits during several cycles of clothes. This multi-use article can be made by filling a hollow sponge with about 20 grams of the fabric treatment composition.

E. Usage

The substrate embodiment of this invention can be used for imparting the above-described fabric treatment composition to fabric to provide softening and/or antistatic effects to fabric in an automatic laundry dryer. Generally, the method of using the composition of the present invention comprises: commingling pieces of damp fabric by tumbling said fabric under heat in an automatic clothes dryer with an effective amount of the fabric treatment composition. At least the continuous phase of said composition has a melting point greater than about 35° C. and the composition is flowable at dryer operating temperature. This composition comprises from about 10% to about 99.99%, preferably from about 15% to about 90%, of the quaternary ammonium agent selected from the above-defined cationic fabric softeners and mixtures thereof, from about 0% to about 95%, preferably from about 20% to about 75%, more preferably from about 20% to about 60% of the above-defined co-softener.

The present invention relates to improved solid dryer-activated fabric softener compositions which are either (A) incorporated into articles of manufacture in which the compositions are, e.g., on a substrate, or are (B) in the form of particles (including, where appropriate, agglomerates, pellets, and tablets of said particles). Such compositions contain from about 30% to about 95% of normally solid, dryer-softenable material, typically fabric softening agent, containing an effective amount of unsaturation.

In the specification and examples herein, all percentages, ratios and parts are by weight unless otherwise specified and all numerical limits are normal approximations.

The following examples illustrate the esters and compositions of this invention, but are not intended to be limiting thereoE

EXAMPLE 1

Dinonadyl maleate

Nonadyl alcohol in the amount of 18.00 g (0.105 mol), maleic anhydride in the amount of 3.47 g (0.035 mol), and p-toluenesulfonic acid in the amount of 69.0 mg (0.363 mmol) were combined with 50 mL of toluene in a flask fitted with a condenser, argon inlet and Dean-Stark trap. The mixture was heated to reflux for 18 h at which time the theoretical amount of water was collected. The product mixture was poured into separatory funnel and washed with saturated $NaHCO_3$ solution (3×50 mL), brine (50 mL), water (50 mL), dried over $MgSO_4$, filtered and concentrated to give a light yellow oil. The product mixture was further concentrated by Kugelrohr distillation at 85° C. (0.1 mm Hg) to give a viscous oil. Purification of the product by column chromatography on silica gel eluting with a 10% solution of ethyl acetate in petroleum ether provided a colorless oil. Purity of the product was determined by thin layer chromatography and the structure confirmed by $^1H$ and $^{13}C$ NMR.

EXAMPLE 2

Di(β-citronellyl)maleate β-Citronellol in the amount of 140.00 g (0.851 mol), maleic anhydride in the amount of 28.10 g (0.284 mol), and p-toluenesulfonic acid in the amount of 0.54 g (2.84 mmol) were combined with 380 mL of toluene in a flask fitted with a condenser, argon inlet and Dean-Stark trap. The mixture was heated to reflux for 27 h at which time the theoretical amount of water was collected. The product mixture was poured into separatory funnel and washed with saturated $NaHCO_3$ solution (3×75 mL), brine (75 mL), water (75 mL), dried over $MgSO_4$, filtered and concentrated to give a light yellow oil. The product mixture was further concentrated by Kugelrohr distillation at 90°–95° C. (0.1 mm Hg) to give a viscous oil. Purification of the product by column chromatography on silica gel eluting with a 10% solution of ethyl acetate in petroleum ether provided a colorless oil. Purity of the product was determined by thin layer chromatography and the structure confirmed by $^1H$ and $^{13}C$ NMR.

EXAMPLE 3

Di(cyclohexylethyl)maleate

Cyclohexylethyl alcohol in the amount of 17.15 g (0.134 mol), maleic anhydride in the amount of 4.42 g (0.045 mol) and p-toluenesulfonic acid in the amount of 0.09 g (0.40 mmol) were combined with 80 mL of toluene in a flask fitted with a condenser, argon inlet and Dean-Stark trap. The mixture was heated to reflux for 18 h at which time the theoretical amount of water was collected. The product mixture was poured into separatory funnel and washed with saturated $NaHCO_3$ solution (3×80 mL), brine (80 mL), water (80 mL), dried over $MgSO_4$, filtered and concentrated to give an oil. The product mixture was further concentrated by Kugelrohr distillation at 85° C. (0.1 mm Hg) to give a viscous oil. Purity of the product was determined by thin layer chromatography and the structure confirmed by $^1H$ and $^{13}C$ NMR.

EXAMPLE 4

Diphenoxanyl maleate

Phenoxanol (phenylhexanol) in the amount of 48.95 g (0.274 mol) and maleic anhydride in the amount of 9.06 g (0.092 mol) were combined with 125 mL of toluene in a flask fitted with a condenser, argon inlet and Dean-Stark trap. The mixture was heated to reflux for 24 h at which time the theoretical amount of water was collected. The cooled mixture was concentrated first by rotary evaporation to remove excess toluene and then by Kugelrohr distillation at 105° C. to remove excess alcohol. Purification of the product by column chromatography on silica gel eluting with a 10% solution of ethyl acetate in petroleum provided a colorless oil. Purity of the product was determined by thin layer chromatography and the structure confirmed by $^1H$ and $^{13}C$ NMR.

EXAMPLE 5

Difloralyl succinate

Floralol in the amount of 17.41 g (0.124 mol), succinic anhydride in the amount of 4.27 g (0.041 mol) and p-toluenesulfonic acid in the amount of 0.10 g (0.53 mmol) were combined with 80 mL of toluene in a flask fitted with a condenser, argon inlet and Dean-Stark trap. The mixture was heated to reflux for 18 h at which time the theoretical amount of water was collected. The product mixture was poured into separatory funnel and washed with saturated $NaHCO_3$ solution (3×80 mL), brine (80 mL), water (80 mL), dried over $MgSO_4$, filtered and concentrated to give an oil. The product mixture was further concentrated by Kugelrohr distillation at 80° C. (0.1 mm Hg) to give a viscous oil. Purity of the product was determined by thin layer chromatography and the structure confirmed by $^1H$ and $^{13}C$ NMR.

EXAMPLE 6

Di(3,7-dimethyl-1-octanyl)succinate

The method of Example 5 is repeated with the substitution of 3,7-dimethyl-1-octanol for floralol.

EXAMPLE 7

Di(phenylethyl)adipate

The method of Example 5 is repeated with the substitution of phenylethanol for floralol and adipic anhydride for succinic anhydride.

EXAMPLE 8

Dryer Sheet Compositions Containing Esters of Perfume Alcohols

| Formulation Example: Ingredient | A Wt. % | B Wt. % | C Wt. % | D Wt. % | E Wt. % | F Wt. % | G Wt. % |
|---|---|---|---|---|---|---|---|
| DEQA (1) | 39.16 | 34.79 | — | 39.16 | — | — | |
| DEQA (2) | — | — | 51.81 | — | — | — | 21.50 |
| DEQA (3) | — | — | — | — | 28.32 | — | |
| DEQA (4) | — | — | — | — | — | 31.33 | |
| Cosoftener (5) | 54.41 | 40.16 | 27.33 | 55.21 | 40.16 | 44.16 | 33.50 |
| Glycosperse S-20 (6) | — | — | 15.38 | — | — | — | 12.00 |
| Sorbitan Monooleate | — | — | — | — | 25.75 | — | 11.98 |
| Clay | 4.02 | 4.02 | 3.16 | 4.02 | 4.12 | 4.52 | 4.52 |
| Perfume | 1.61 | 1.65 | 1.52 | 1.11 | 1.15 | 1.11 | 1.90 |
| Perfume/ Cyclodextrin complex | — | 18.88 | — | — | — | 18.38 | 14.10 |
| Dinonadyl maleate (7) | 0.80 | — | — | — | — | 0.25 | 0.50 |
| Diphenoxanyl maleate (8) | — | 0.50 | — | — | — | — | |
| Dicitronellyl maleate (9) | — | — | 0.80 | — | — | — | |
| Difloralyl succinate (10) | — | — | — | 0.50 | — | 0.25 | |
| Di(cyclohexylethyl) maleate (11) | — | — | — | — | 0.50 | — | |

(1) Di-(oleyloxyethyl) dimethyl ammonium methylsulfate

-continued

| Formulation Example: Ingredient | A Wt. % | B Wt. % | C Wt. % | D Wt. % | E Wt. % | F Wt. % | G Wt. % |
|---|---|---|---|---|---|---|---|

(2) Di-(soft-tallowyloxyethyl) hydroxyethyl methyl ammonium methylsulfate
(3) Di-(soft-tallowyloxyethyl) dimethyl ammonium methylsulfate
(4) Di-(soft-tallowyloxy) trimethyl ammoniopropane methylsulfate
(5) 1:2 Ratio of stearyl dimethyl ammine:triple-pressed stearic acid
(6) Polyethoxylated sorbitan monostearate, available from Lonza
(7) 1,4-Butendioic acid, 1,5,7-trimethyl-1-ocatanyl ester
(8) 1,4-Butendioic acid, 3-methyl-5-phenyl-1-pentanyl ester
(9) 1,4-Butendioic acid, 3,7-dimethyl-1-oct-6-enyl ester
(10) 1,4-Butandioic acid, (4,6-dimethyl-cyclohex-3-ene)methyl ester
(11) 1,4-Butendioic acid, 2-cyclohexyl-ethyl ester Preparation of Coating Mix (Formula A)

A batch of approximately 200 g is prepared as follows: Approximately 109 g of co-softener and about 78 g DEQA(1) are melted separately at about 80° C. They are combined with high shear mixing in a vessel immersed in a hot water bath to maintain the temperature between 70°–80° C. Calcium bentonite clay (8 g) is mixed in to achieve the desired viscosity. Dinonadyl maleate (1.6 g) and perfume (3.2 g) are added to the formula and mixed until homogeneous.

Coating mixes for Formulas B–F are made in a like manner, using the materials indicated in the table above.

Preparation of Fabric Conditioning Sheets

The coating mixture is applied to preweighed substrate sheets of about 6.75 inches×12 inches (approximately 17 cm×30 cm) dimensions. The substrate sheets are comprised of about 4-denier spun bonded polyester. A small amount of the formula is placed on a heated metal plate with a spatula and then is spread evenly with a wire metal rod. A substrate sheet is placed on the metal plate to absorb the coating mixture. The sheet is then removed from the heated metal plate and allowed to cool to room temperature so that the coating mix can solidity. The sheet is weighed to determine the amount of coating mixture on the sheet. The target sheet weight is 3.49 g. If the weight is in excess of the target weight, the sheet is placed back on the heated metal plate to remelt the coating mixture and remove some of the excess. If the weight is under the target weight, the sheet is also placed on the heated metal plate and more coating mixture is added.

What is claimed is:

1. A dryer added, dryer-activated fabric softening composition comprising:

(A) from 10% to 99.99% of a fabric softening compound; and (B) from 0.01% to about 15% by weight of the composition, of a diester having the formula $R_1R'R_2$ wherein R' is a residue of an acid forming diester selected from the group consisting of succinic acid or maleic acid; and wherein $R_1$ and $R_2$ independently represent a residue of an alcohol forming diester selected from the group consisting of phenoxanol, floralol, B-citronellol, nonadyl, cyclohexyl ethanol, phenyl ethanol, isoborneol, fenchol, isocyclogeraniol, 2-phenyl-1-propanol, 3,7-dimethyl-1-octanol and mixtures thereof; and wherein said dryer added fabric softening composition is in the form of a tablet or attached to a substrate.

2. The dryer-activated fabric conditioning composition of claim 1 comprising:

(A) from about 10% to about 95% of a fabric softening compound comprising a quaternary ammonium compound selected from the group consisting of the compounds of:

$$(R^1)_{4-p}-N^+-((CH_2)_v-Y-R^2)_pX^- \qquad \text{Formula I}$$

wherein each Y' is —O—(O)C—, or —C(O)—O—;

p is 1 to 3;

each v is an integer from1 to 4;

each $R^1$ substituent is a short chain $C_1$–$C_6$ alkyl group;

each $R^2$ is $C_8$–$C_{30}$ hydrocarbyl substituent; and the counterion, $X^-$, can be any softener-compatible anion; and

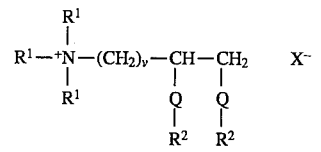

Formula II wherein each Q is —O—C(O)— or —C(O)—O—e each $R^3$ is $C_1$–$C_4$ alkyl or hydroxy alkyl group;

each $R^2$, v, and $X^-$ are defined hereinbefore for Formula I;

$$R^1-\underset{\underset{R^4}{|}}{N^+}((CH_2)_v-Y-R^2)_p \quad X^- \qquad \text{Formula III:}$$

wherein $R^4$ is a short chain $C_1$–$C_4$ alcohol;

p is 2;

$R^1$, $R^2$, v, Y', and $X^-$ are defined hereinbefore for Formula I;

$$(R^1)_{4-p}-N^+-((CH_2)_v-Y''-R^2)_p \quad X^- \qquad \text{Formula IV:}$$

wherein $R^1$, $R^2$, p, v, and $X^-$ are defined hereinbefore for Formula I; and $$Y'' = -NH-\overset{\overset{O}{||}}{C};\ -\overset{\overset{O}{||}}{C}-NH-;\ O-\overset{\overset{O}{||}}{C}-;\ -\overset{\overset{O}{||}}{C}-O;\ \text{and}$$

mixtures thereof, wherein at least one Y" group is $$-NH-\overset{\overset{O}{||}}{C}\ \text{or}\ -\overset{\overset{O}{||}}{C}-NH-;$$

and mixtures thereof:

(C) optionally, from 0% to about 95% of co-softener comprising a carboxylic acid salt of a tertiary amine, tertiary amine ester, or mixtures thereof;

(D) optionally, from 0% to about 50% of nonionic softener; wherein the Iodine Value of the total number of fatty acyl groups present in (A), (C), and (D) is from about 3 to about 60.

3. The composition of claim 2 wherein the quaternary ammonium compound is fully saturated Formula I compound.

4. The composition of claim 3 wherein the Formula I compound is dimethyl bis(tallowyl oxy ethyl)ammonium methyl sulfate, derived from hardened tallow.

5. The composition of claim 2 wherein the composition comprises from about 15% to about 90% of Formula I compound and the Iodine Value is from about 8 to about 50.

6. The composition of claim 5 wherein the Formula I compound comprises dimethyl bis(acyl oxy ethyl)ammonium methyl sulfate derivatives of $C_8$–$C_{30}$ fatty acids, and mixtures thereof.

7. The composition of claim 6 wherein the Formula I compound is selected from the group consisting of dimethyl bis(tallowyl oxy ethyl) ammonium methyl sulfate; dimethyl bis(oleyl oxy ethyl) ammonium methyl sulfate; dimethyl bis(cocoyl oxy ethyl) ammonium methyl sulfate, and mixtures thereof.

8. The composition of claim 7 wherein the carboxylic acid salt forming anion moiety of the co-softener is selected from the group consisting of lauric, myristic, palmitic, stearic, oleic and mixtures thereof.

9. The composition of claim 8 wherein the amine salt is selected from the group consisting of oleyldimethylamine stearate, dioleylmethylamine stearate, linoleyldimethylamine stearate, dilinoleylmethylamine stearate, stearyldimethylamine stearate, distearylmethylamine myristate, stearyldimethylamine palmitate, distearylmethylamine palmitate, distearylmethylamine myristate, distearylmethylamine palmitate, distearylmethylamine laurate, dioleyldistearylmethylamine oleate, distearylmethylamine oleate, and mixtures thereof.

10. The composition of claim 9 wherein said ester component (B) is selected from a group consisting of di(β-citronellyl) maleate, dinonadyl maleate, diphenoxanyl maleate, di(3,7-dimethyl-1-octanyl) succinate, di(cyclohexylethyl) maleate, difloralyl succinate.

11. The composition of claim 10 wherein the composition additionally comprises:

(A) from 0% to about 2% of stabilizer selected from the group consisting of ascorbic acid, ascorbic palmitate, propyl gallate, citric acid, butylated hydroxytoluene, tertiary butylhydroquinone, natural tocopherols, butylated hydroxyanisole and mixtures thereof;

(B) from 0% to about 10% of soil release polymer; and (C) mixtures thereof.

12. The composition of claim 2 comprising:

(A) from about 30% to about 85% of dimethyl bis(tallowyl oxy ethyl) ammonium methyl sulfate, dimethyl bis(oleyl oxy ethyl) ammonium methyl sulfate, dimethyl bis(cocoyl oxy ethyl) ammonium methyl sulfate, and mixtures thereof;

(C) from about 20% to about 75% of oleyldimethylamine stearate, distearylmethylamine myristate, and mixtures thereof; and (D) from about 15% to about 40% of $C_{10}$–$C_{26}$ acyl sorbitan monoester, diester, and mixtures thereof;

wherein the composition has a thermal softening point of from about 35° C. to about 100° C.

13. The composition of claim 12 wherein (D) is sorbitan monooleate, and sorbitan monostearate, and mixtures thereof.

14. The composition of claim 2 wherein the ratio of A:C:D is 5:3:2.

15. The composition of claim 14 wherein the amine salt comprises a mixture of oleyldimethylamine stearate and distearylmethylamine myristate in a weight ratio of from 1:10 to 10:1.

16. The composition of claim 2 wherein the composition comprises from about 15% to about 90% of Formula II compound and the Iodine Value is from about 8 to about 50.

17. The composition of claim 16 wherein the Formula II compound is selected from the group consisting of 1,2-bis(tallowyl oxy)-3-trimethyl ammonium methylsulfate, 1,2-bis(oleyl oxy)-3-trimethyl ammonium methylsulfate, 1,2-bis(cocoyl oxy)-3-trimethyl ammonium methylsulfate, and mixtures thereof.

18. The composition of claim 16 wherein the carboxylic acid salt forming anion moiety of the co-softener is selected from the group consisting of lauric, myristic, palmitic, stearic, oleic and mixtures thereof.

19. The composition of claim 18 wherein the amine salt is selected from the group consisting of oleyldimethylamine stearate, dioleylmethylamine stearate, linoleyldimethylamine stearate, dilinoleylmethylamine stearate, stearyldimethylamine stearate, distearylmethylamine myristate, stearyldimethylamine palmitate, distearylmethylamine palmitate, distearylmethylamine myristate, distearylmethylamine palmitate, distearylmethylamine laurate, dioleylmethylamine oleate, distearylmethylamine oleate, and mixtures thereof.

20. The composition of claim 19 wherein said ester component (B) is selected from a group consisting of di(β-citronellyl) maleate, dinonadyl maleate, diphenoxanyl maleate, di(3,7-dimethyl-1-octanyl) succinate, di(cyclohexylethyl) maleate, difloralyl succinate.

21. The composition of claim 20 wherein the composition additionally comprises:

(A) from 0% to about 2% of a stabilizer selected from the group consisting of ascorbic acid, ascorbic palmitate, propyl gallate, citric acid, butylated hydroxytoluene, tertiary butylhydroquinone, natural tocopherols, butylated hydroxyanisole and mixtures thereof;

(B) from 0% to about 10% of a soil release polymer; and (C) mixtures thereof.

22. The composition of claim 2 wherein the composition contains from about 15% to about 90% of Formula III compound and the Iodine Value is from about 8 to about 50.

23. The composition of claim 22 wherein the Formula III compound comprises N-methyl-N,N-di-(2-($C_8$–$C_{30}$)-acyioxy ethyl), N-2-hydroxyethyl ammonium methylsulfate, and mixtures thereof.

24. The composition of claim 23 wherein the carboxylic acid salt forming anion moiety of the co-softener is selected from the group consisting of lauric, myristic, palmitic, stearic, oleic and mixtures thereof.

25. The composition of claim 23 wherein the amine salt is selected from the group consisting of oleyldimethylamine stearate, dioleylmethylamine stearate, linoleyldimethylamine stearate, dilinoleylmethylamine stearate, stearyldimethylamine stearate, distearylmethylamine myristate, stearyldimethylamine palmitate, distearylmethylamine palmitate, distearylmethylamine myristate, distearylmethylamine palmitate, distearylmethylamine laurate, dioleyldistearylmethylamine oleate, distearylmethylamine oleate, and mixtures thereof.

26. The composition of claim 25 wherein said ester component (C) is selected from a group consisting of di(β-citronellyl) maleate, dinonadyl maleate, diphenoxanyl maleate, di(3,7-dimethyl-1-octanyl) succinate, di(cyclohexylethyl) maleate, difloralyl succinate.

27. The composition of claim 26 wherein the composition additionally comprises:

(A) from 0% to about 2% of a stabilizer selected from the group consisting of ascorbic acid, ascorbic palmitate, propyl gallate, citric acid, butylated hydroxytoluene, tertiary butylhydroquinone, natural tocopherols, butylated hydroxyanisole and mixtures thereof;

(B) from 0% to about 10% of a soil release polymer; and (C) mixtures thereof.

28. A process of treating textiles comprising:

contacting textiles in a laundry dryer with a fabric softening effective amount of a fabric softening composition comprising from 10% to 99.99% of a fabric softening compound and from 0.01% to about 15% by weight of the composition a diester having the formula $R_1R'R_2$ wherein R' is a residue of a dicarboxylic acid forming diester selected from the group consisting of succinic acid or maieic acid; and wherein $R_1$ and $R_2$ independently represent a residue of an alcohol forming diester selected from the group consisting of phenoxanol, floralol, B-citronellol, nonadyl, cyclohexyl ethanol, phenyl ethanol, isoborneol, fenchol, isocyclogeraniol, 2-phenyl-1-propanol, 3,7-dimethyl-1-octanol and mixtures thereof.

* * * * *